US011204164B2

(12) United States Patent
Gambacorta et al.

(10) Patent No.: US 11,204,164 B2
(45) Date of Patent: Dec. 21, 2021

(54) SYSTEM WITH CONDUIT ARRANGEMENT FOR DUAL UTILIZATION OF COOLING FLUID IN A COMBUSTOR SECTION OF A GAS TURBINE ENGINE

(71) Applicant: Siemens Energy Global GmbH & Co. KG, Munich (DE)

(72) Inventors: Domenico Gambacorta, Oviedo, FL (US); Wojciech Dyszkiewicz, Winter Springs, FL (US); Daniel Cassar, Charlotte, NC (US); Clifford E. Johnson, Orlando, FL (US)

(73) Assignee: Siemens Energy Global GmbH & Co. KG, Munich (DE)

( * ) Notice: Subject to any disclaimer, the term of this patent is extended or adjusted under 35 U.S.C. 154(b) by 107 days.

(21) Appl. No.: 16/488,655

(22) PCT Filed: Mar. 22, 2018

(86) PCT No.: PCT/US2018/023763

§ 371 (c)(1),
(2) Date: Aug. 26, 2019

(87) PCT Pub. No.: WO2018/183078

PCT Pub. Date: Oct. 4, 2018

(65) Prior Publication Data

US 2020/0063959 A1 Feb. 27, 2020

Related U.S. Application Data

(60) Provisional application No. 62/478,799, filed on Mar. 30, 2017, provisional application No. 62/478,826, filed on Mar. 30, 2017.

(51) Int. Cl.

| | |
|---|---|
| ***F23M 5/00*** | (2006.01) |
| ***F23M 5/08*** | (2006.01) |
| ***F23R 3/00*** | (2006.01) |

(52) U.S. Cl.
CPC ..... *F23M 5/085* (2013.01); *F23R 3/002* (2013.01); *F05D 2260/964* (2013.01); *F23R 2900/00014* (2013.01); *F23R 2900/03043* (2013.01)

(58) Field of Classification Search
CPC ..... F23R 2900/00014; F23R 3/002; F23R 2900/03043; F23M 5/085; F05D 2260/964
See application file for complete search history.

(56) References Cited

U.S. PATENT DOCUMENTS 5,373,695 A 12/1994 Aigner et al.
8,720,204 B2 5/2014 Schilp et al.
(Continued)

FOREIGN PATENT DOCUMENTS

EP 0512670 A1 11/1992
EP 2187021 A1 5/2010
(Continued)

OTHER PUBLICATIONS

PCT International Search Report and Written Opinion of International Searching Authority dated Jul. 18, 2018 corresponding to PCT International Application No. PCT/US2018/023763 filed Mar. 22, 2018.

*Primary Examiner* — Katheryn A Malatek

(57) ABSTRACT

A system effective for dual utilization of cooling fluid in a gas turbine engine is provided. A cooling annulus is subject to a hot-temperature combustion flow received from a combustor basket and includes a liner including a feed channel to receive cooling fluid. A feed manifold is in fluid communication with feed channel to feed cooling fluid to a plurality of conduits in fluid communication with a plurality of exit orifices that is in fluid communication with a plurality of resonators. A distributor manifold includes a plurality of manifold sectors in fluid communication with a plurality of
(Continued)

conduits arranged to convey cooling fluid. Some of the plurality of resonators operates with different amounts of cooling fluid. A group of the plurality of exit orifices is configured to supply an amount of cooling fluid appropriate for a resonator in fluid communication with the group of the plurality of exit orifices.

16 Claims, 6 Drawing Sheets

(56) References Cited

U.S. PATENT DOCUMENTS

| | | | | |
|---|---|---|---|---|
| 9,410,494 | B2 | 8/2016 | Michel | |
| 2007/0283700 | A1* | 12/2007 | Gerendas | F23R 3/002 60/754 |
| 2010/0170260 | A1* | 7/2010 | Mawatari | F23R 3/005 60/755 |
| 2011/0220433 | A1 | 9/2011 | Nakamura et al. | |
| 2012/0198854 | A1 | 8/2012 | Schilp et al. | |
| 2012/0234009 | A1 | 9/2012 | Boettcher et al. | |
| 2013/0098063 | A1 | 4/2013 | Mizukami et al. | |
| 2015/0020498 | A1 | 1/2015 | Schilp | |
| 2018/0180288 | A1* | 6/2018 | Kugimiya | G10K 11/162 |

FOREIGN PATENT DOCUMENTS

| | | | |
|---|---|---|---|
| EP | 2500648 | A1 | 9/2012 |
| JP | H06221563 | A | 8/1994 |
| JP | 2005315473 | A | 11/2005 |
| JP | 2012077660 | A | 4/2012 |
| JP | WO2010097982 | A1 | 8/2012 |
| JP | 2013140248 | A | 7/2013 |
| JP | 2016525207 | A | 8/2016 |
| WO | 2016013585 | A1 | 1/2016 |

* cited by examiner

SYSTEM WITH CONDUIT ARRANGEMENT FOR DUAL UTILIZATION OF COOLING FLUID IN A COMBUSTOR SECTION OF A GAS TURBINE ENGINE

This application claims benefit of the Mar. 30, 2017 concurrent filing date of U.S. provisional applications 62/478,826 and 62/478,799, both of which are incorporated by reference herein.

FIELD OF THE INVENTION

Disclosed embodiments are generally related to a combustion turbine engine, and, more particularly, to a system with a conduit arrangement effective for dual utilization of cooling fluid in a combustor section of a gas turbine engine.

BACKGROUND OF THE INVENTION

A combustion turbine engine, such as a gas turbine engine, includes for example a compressor section, a combustor section and a turbine section. Intake air is compressed in the compressor section and then mixed with fuel, and a resulting mixture of air and fuel is ignited in the combustor section to produce a high-temperature and high-pressure combustion flow, which is conveyed to the turbine section of the engine, where thermal energy is converted to mechanical energy.

During operation of the turbine engine, acoustic pressure oscillations can develop in the combustor section at undesirable frequencies. Such pressure oscillations can damage components in the combustor section. To avoid such damage, one or more acoustic damping devices may be arranged in the combustor section of the turbine engine. One commonly used acoustic damping device is a resonator, such as a Helmholtz resonator. During engine operation cooling fluid, e.g., some the air compressed in the combustor section, may, for example, be conveyed to an internal cavity of the resonator through holes on top of a resonator box. The cooling fluid can exit the resonator through liner orifices in fluid communication with a combustion zone, where this cooling fluid may be mixed with the mixture of fuel and air being ignited in the combustor section. Examples of resonator arrangements are described in U.S. Pat. Nos. 8,720,204 and 9,410,494.

BRIEF DESCRIPTION OF THE DRAWINGS

The invention is explained in the following description in view of the drawings that show.

DETAILED DESCRIPTION OF THE INVENTION

Figure 1:
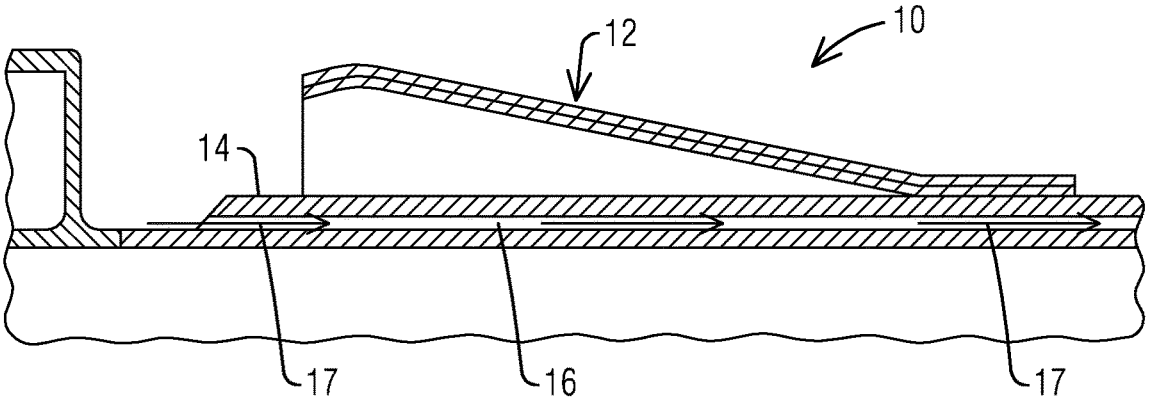
FIG. 1 PRIOR ART
FIG. 1 shows a partial, cross-sectional view of a portion of a prior art combustor section.

FIG. 1 shows a partial, cross-sectional view of a prior art combustor section 10 in a combustion turbine engine, such as a gas turbine engine. Combustor section 10 may include a spring clip assembly 12 and a cooling ring 14 having cooling channels 16 that allow cooling fluid, such as air (schematically represented by arrows 17) to enter on an upstream side of cooling ring 14 and exit at a downstream side of cooling ring 14, where the cooling fluid is dumped at a location downstream from a combustion zone in the combustor section.

The present inventors have recognized that since the cooling fluid is dumped at a location, which is downstream of the location where the actual combustion process occurs, then this cooling fluid is practically unable to participate in the combustion process, which can lead to higher NOx emissions and reduced engine efficiency.

At least in view of the foregoing considerations, the present inventors propose in disclosed embodiments, an innovative system effective for dual utilization of cooling fluid in the combustor section of a gas turbine engine. That is, a system that makes regenerative use of cooling fluid—that was previously used solely for cooling the cooling ring to be additionally used—for fulfilling resonator fluid cooling and purging requirements. Without limitation, this may involve reusing the cooling fluid previously dumped at the downstream end of the cooling ring. For example, in lieu of such cooling fluid being dumped at the downstream end of the cooling ring, in disclosed embodiments this cooling fluid may be re-routed upstream towards the resonator section for purposes of resonator cooling, for example.

It will be appreciated that cooling fluid that was previously dumped at the exit of the cooling ring, which previously was unable to participate in the combustion process can now be effectively re-used for resonator cooling purposes and then be mixed with the mixture of fuel and air in the combustor section where such cooling fluid can now effectively participate in the combustion process. Thus, the proposed system is expected to advantageously result in lower NOx emissions and increased engine efficiency compared to the arrangement shown in FIG. 1.

The present inventors have further recognized that in a practical implementation of a resonator arrangement at least some of the resonators may involve different resonator configurations that may require different amounts of cooling fluid. Thus, if one provides equals amount of the cooling fluid to the different resonator configurations regardless of the actual cooling fluid requirements of such resonators, as described in U.S. Pat. No. 8,720,204, then resonators with lesser cooling fluid needs may be supplied with an unnecessarily larger amount of the cooling fluid. Conversely, resonators with higher fluid cooling needs could experience at least some cooling fluid starvation.

In view of such further recognition, disclosed embodiments further propose a system that may be configured to supply an amount of the cooling fluid, which is appropriate for meeting the specific cooling fluid needs of each respective resonator.

In the following detailed description, various specific details are set forth in order to provide a thorough understanding of such embodiments. However, those skilled in the art will understand that embodiments of the present invention may be practiced without these specific details, that the present invention is not limited to the depicted embodiments, and that the present invention may be practiced in a variety of alternative embodiments. In other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

The terms "comprising", "including", "having", and the like, as used in the present application, are intended to be synonymous unless otherwise indicated. Lastly, as used herein, the phrases "configured to" or "arranged to" embrace the concept that the feature preceding the phrases "configured to" or "arranged to" is intentionally and specifically designed or made to act or function in a specific way and should not be construed to mean that the feature just has a capability or suitability to act or function in the specified way, unless so indicated.

Figure 2:
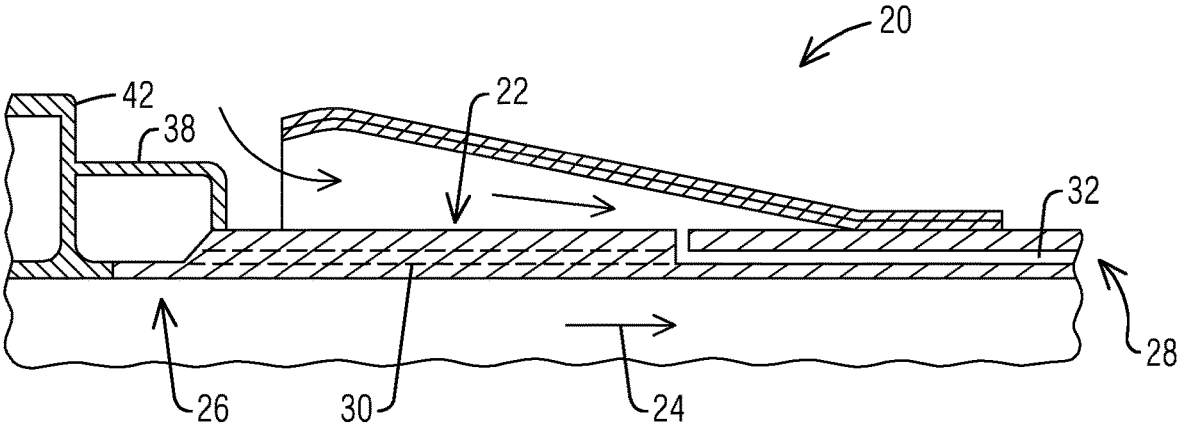
FIG. 2 shows a partial, cross-sectional view of one non-limiting embodiment of a disclosed system effective for dual utilization of a cooling fluid in a gas turbine engine.

FIG. 2 shows a partial, cross-sectional view of a disclosed system 20 effective for dual utilization of a cooling fluid in a combustor section of a gas turbine engine. In one non-limiting embodiment, system 20 includes a cooling annulus 22 (e.g., a cooling ring) subject to hot-temperature combustion flow (schematically represented by arrow 24) received from a combustor basket (not shown).

Figure 3:
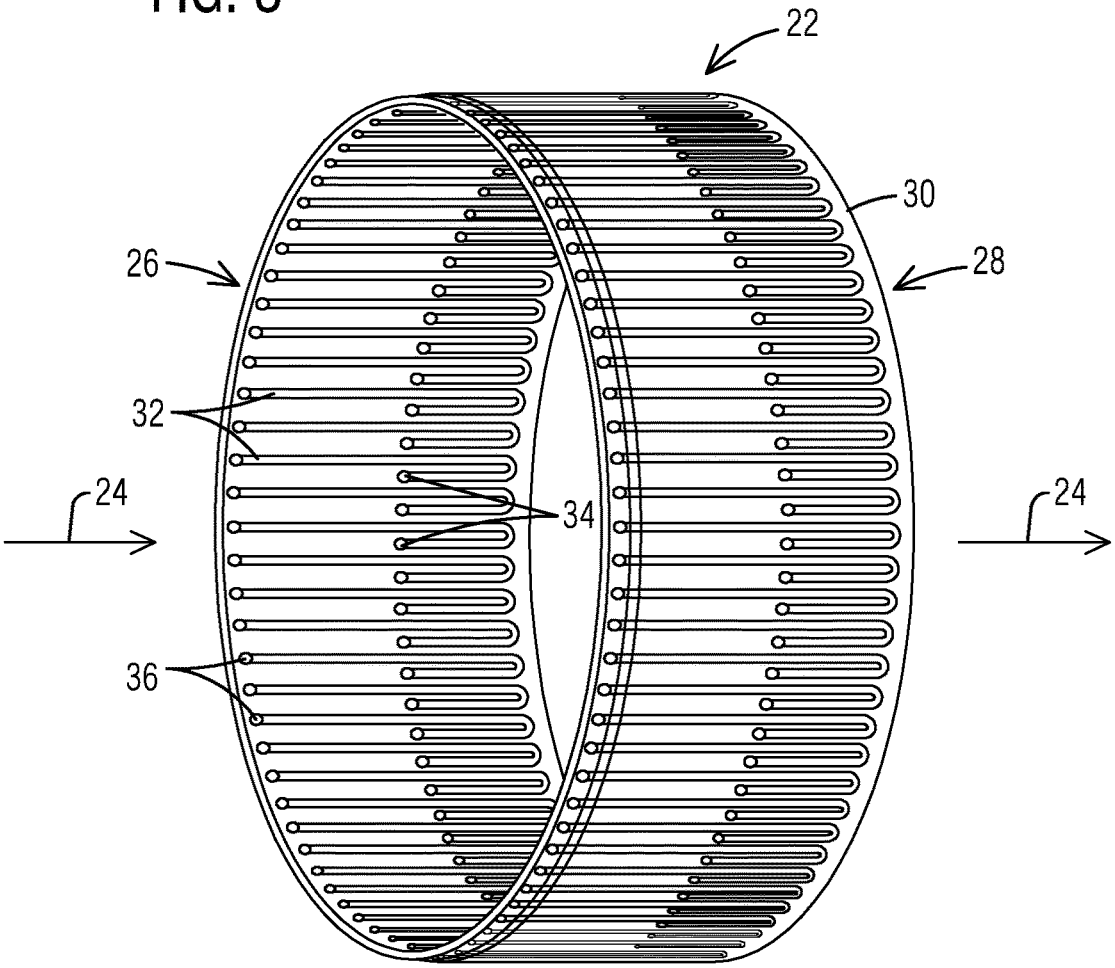
FIG. 3 shows a perspective view of a disclosed cooling annulus illustrating one non-limiting embodiment of a conduit arrangement for conveying the cooling fluid.

As seen in FIG. 3, the hot-temperature combustion flow passes between an upstream side 26 and a downstream side 28 of cooling annulus 22. As further seen in FIG. 3, in one non-limiting embodiment, cooling annulus 22 comprises a liner 30 including a plurality of conduits 32 arranged to convey cooling fluid received at a plurality of admittance orifices 34 to a plurality of exit orifices 36.

Figure 7:
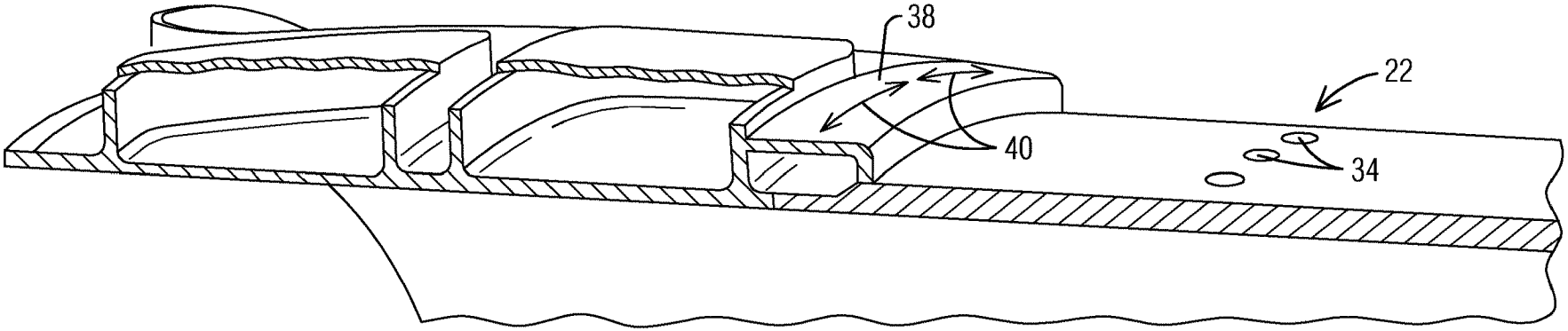
FIG. 7 is a partial, perspective view of the disclosed system shown in FIG. 2.

Returning to FIG. 2, in one non-limiting embodiment, system 20 further includes a distributor manifold 38 that in one-non-limiting embodiment may be disposed proximate to upstream end 26 of cooling annulus 22. In one non-limiting embodiment, distributor manifold 38 may be conceptualized as defining a plurality of circumferentially extending manifold sectors (two such manifold sectors are schematically represented by twin-headed arrows 40 in FIG. 7) in fluid communication with the plurality of exit orifices 36 of cooling annulus 22 to receive the cooling fluid conveyed by conduits 32. It will be appreciated that distributor manifold 38 may be a single-piece or a multi-piece structure.

Figure 5:
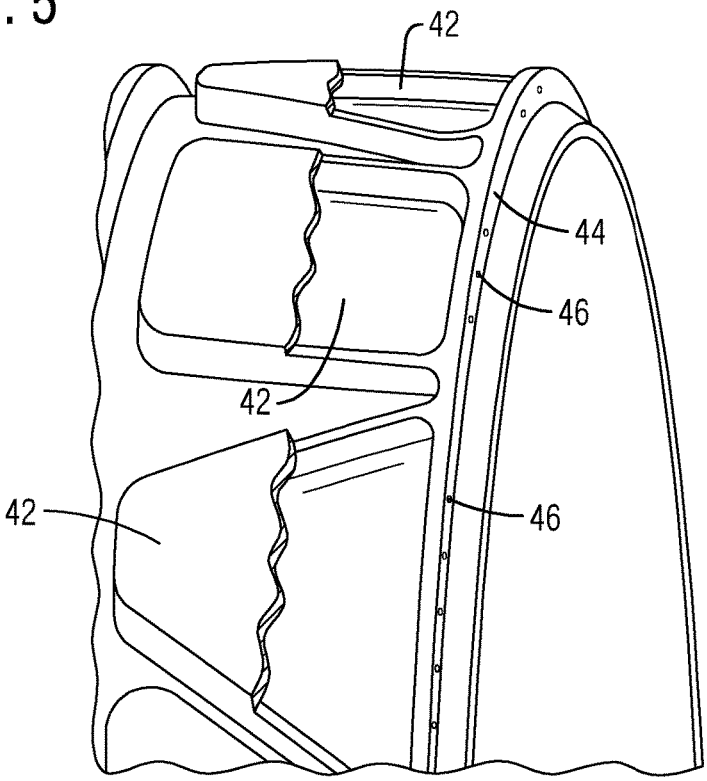
FIGS. 5 and 6 show respective perspective views of one non-limiting embodiment of resonators that may benefit from a disclosed system.
Figure 6:
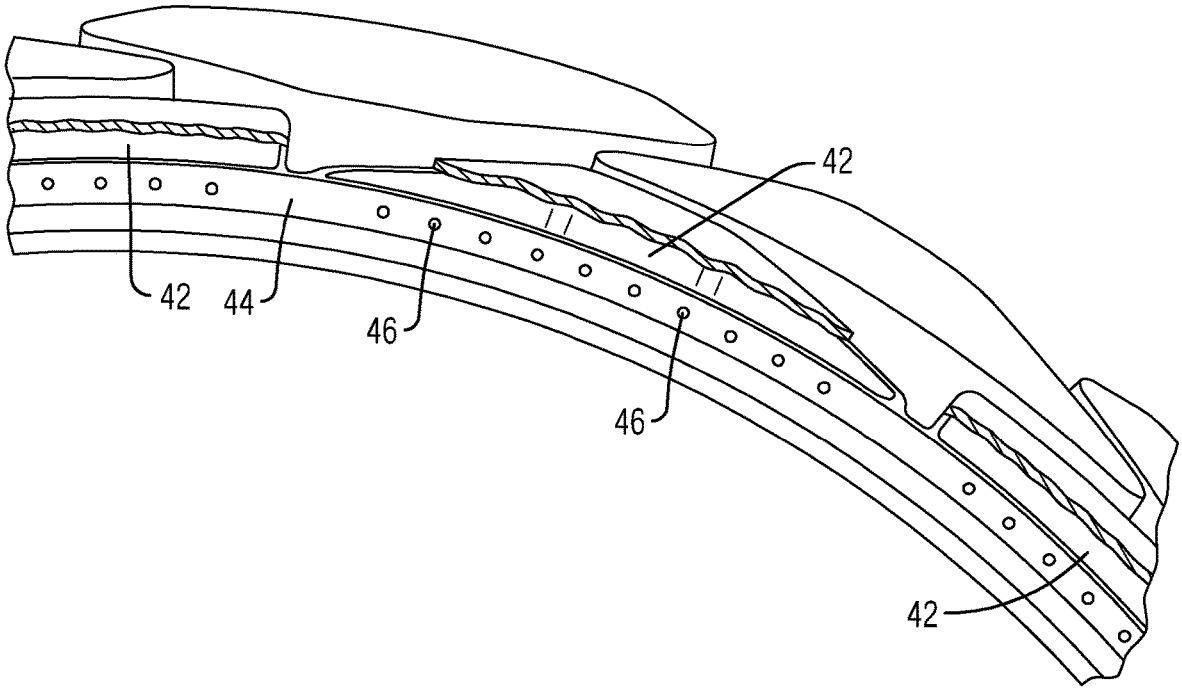

A plurality of resonators 42 (a fragmentary view of one such resonator is seen in FIG. 2) is in fluid communication with distributor manifold 38. As noted above, in practical embodiments, as may be appreciated in FIGS. 5 and 6, at least some of the plurality of resonators 42 (shown with fragmentary views of their respective cover lids) may involve different resonator configurations that may require different amounts of cooling fluid. As may be further appreciated in FIGS. 5 and 6, in one non-limiting embodiment, the plurality of resonators may comprise a common circumferentially extending wall 44 (e.g., a downstream end wall) including wall orifices 46 in fluid communication with distributor manifold 38 (not shown in FIGS. 5 and 6) to receive the cooling fluid. In one non-limiting embodiment, the plurality of resonators 42 may be constructed in the liner of the combustor basket using an appropriate manufacturing technique, such as machining, laser cutting, etc.

In one non-limiting embodiment, a respective one of the plurality of manifold sectors 40 (FIG. 7) of distributor manifold 38 may be configured to supply an amount of the cooling fluid appropriate for a respective one of the plurality of resonators 42 in fluid communication with the respective one of the plurality of manifold sectors 40 of distributor manifold 38. For example, the respective one of the plurality of manifold sectors 40 of distributor manifold 38 may involve a different number of wall orifices and/or a different orifice geometry to supply the amount of the cooling fluid appropriate for the respective one of the plurality of resonators 42 in fluid communication with the respective one of the plurality manifold sectors 40 of the distributor manifold. For example, a manifold sector fluidly coupled to a resonator that needs a higher amount of the cooling fluid may include a higher number of orifices relative to a manifold sector fluidly coupled to a resonator that needs a lower amount of the cooling fluid.

Figure 4:
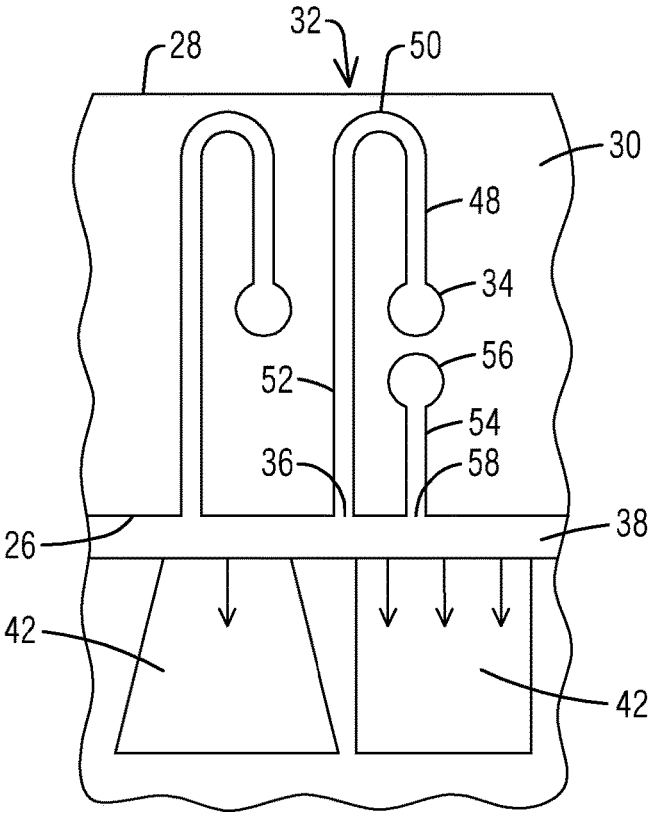
FIG. 4 shows schematic details of non-limiting embodiments of conduits that may be arranged in the disclosed cooling annulus shown in FIG. 3.

As shown in FIG. 4, in one non-limiting embodiment a respective one of the plurality of conduits 32 may comprise a first conduit segment 48 (e.g., a straight conduit segment) extending in a downstream direction from a respective admittance orifice 34 to a start of a second conduit segment 50 (e.g., a curving segment) routed from the downstream direction to an upstream direction. Conduit 32 my further comprise a third conduit segment 52 (e.g., a straight conduit segment) extending in the upstream direction from an end of the second conduit segment 50 to a respective exit orifice 36 in fluid communication with the distributor manifold 38. Without limitation, first conduit segment 48, second conduit segment 50 and third conduit segment 52 in combination may be conceptualized as defining a J-shaped conduit. In one non-limiting embodiment, first conduit segment 48, second conduit segment 50 and third conduit segment 52 may extend along coplanar axes in the cooling annulus.

Figure 11:
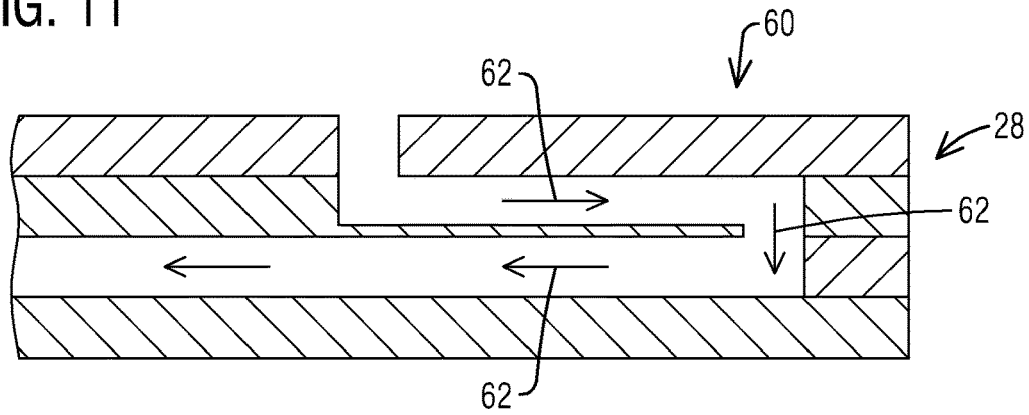
FIG. 11 shows a partial, cross-sectional view of conduits that may be arranged in a liner of a cooling annulus comprising a stacked multipanel arrangement.

In another non-limiting embodiment, shown in FIG. 11, where the liner of the cooling annulus may comprise a stacked multipanel arrangement 60, the conduit segments discussed in the context of FIG. 4. (e.g., first conduit segment 48, second conduit segment 50 and third conduit segment 52) may extend along non-coplanar axes in the cooling annulus, as schematically represented by arrows 62 in FIG. 11. That is, such conduits need not be co-planar.

As further shown in FIG. 4, in one non-limiting embodiment a further one 54 of the plurality of conduits may comprises a conduit segment (e.g., a straight conduit segment) extending in the upstream direction from a respective admittance orifice 56, such as may be spaced apart upstream from the respective admittance orifice 34 of first conduit segment 48 to a respective exit orifice 58 in fluid communication with distributor manifold 38.

Figure 9:
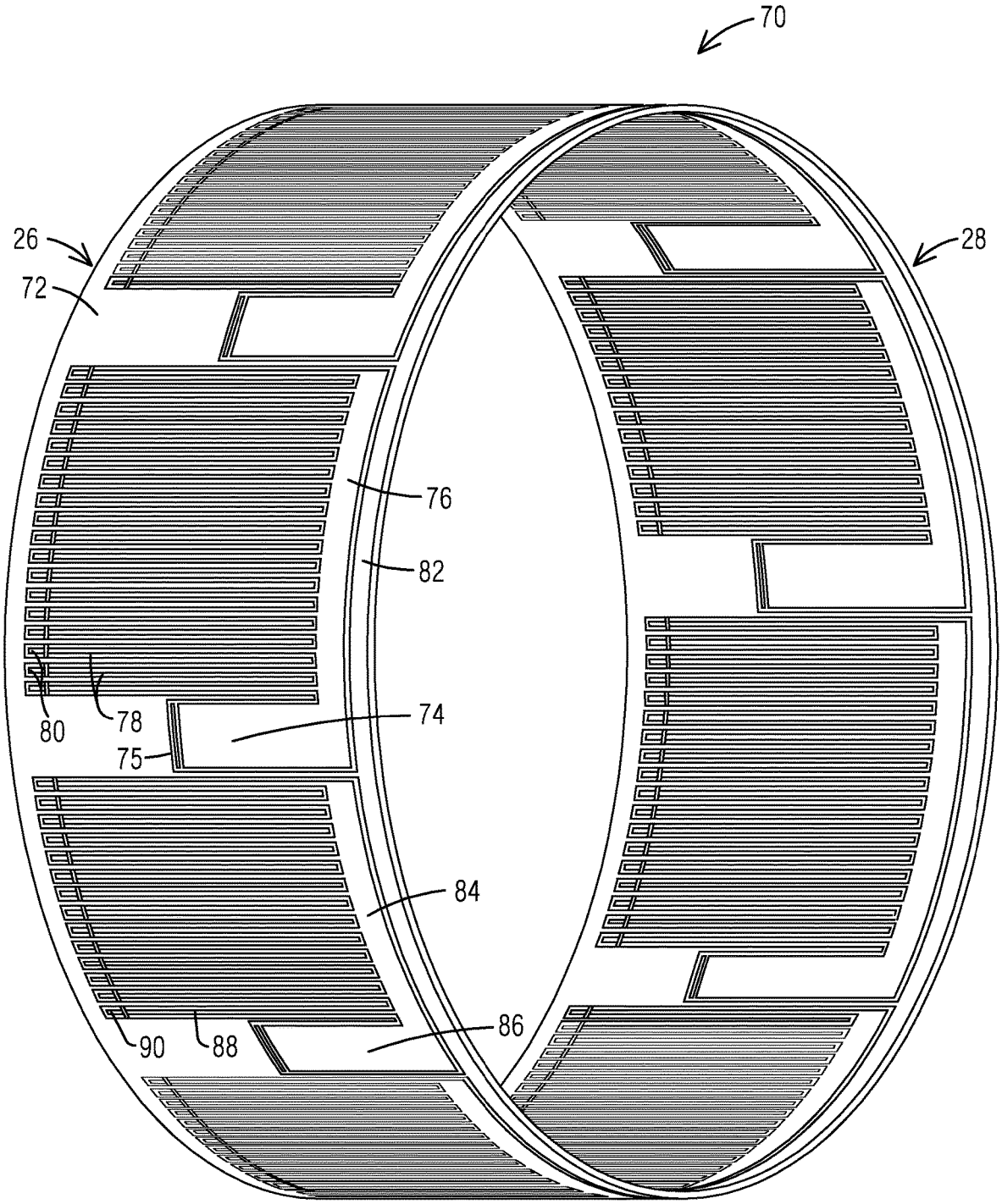
FIG. 9 shows a perspective view of a disclosed cooling annulus illustrating another non-limiting embodiment of a conduit arrangement for conveying the cooling fluid and including a feed manifold.
Figure 10:
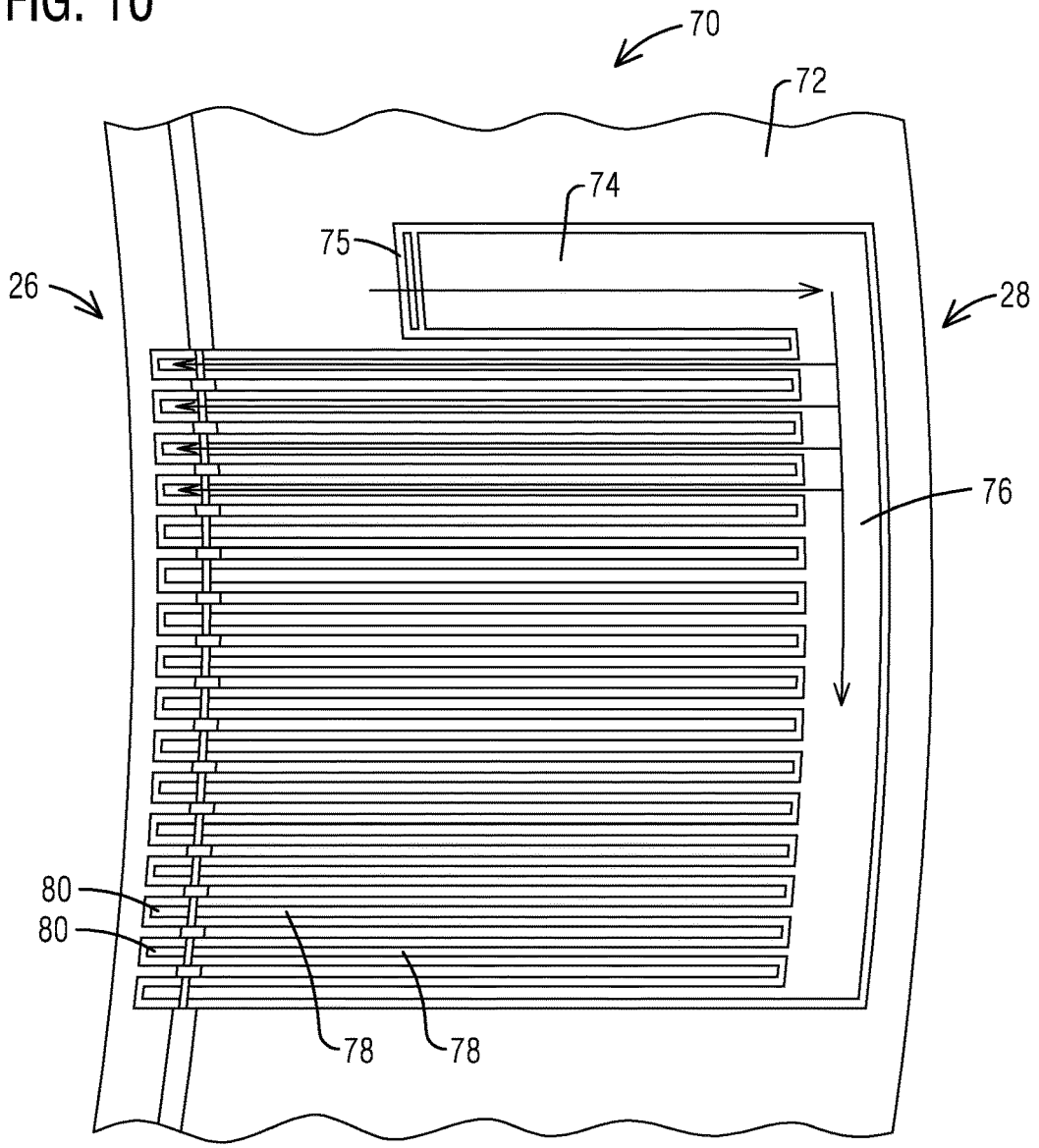
FIG. 10 shows schematic details in connection with a portion of the conduit arrangement shown in FIG. 9.

FIG. 9 shows a perspective view of a disclosed cooling annulus 70 illustrating another non-limiting embodiment of a conduit arrangement for conveying the cooling fluid. FIG. 10 shows zoomed-in details in connection with a portion of the conduit arrangement shown in FIG. 9. In this embodiment, cooling annulus 70 comprises a liner 72 including at least one feed channel 74, such as may have an entrance 75 disposed between the upstream side 26 and the downstream side 28 of the cooling annulus to receive the cooling fluid.

Cooling annulus 70 further includes a feed manifold 76 in fluid communication with feed channel 74 to feed the cooling fluid to a plurality of conduits 78 that extend in an upstream direction, and which are in fluid communication with a plurality of exit orifices 80 of the cooling annulus. In one non-limiting embodiment feed manifold 76 may be disposed proximate the downstream side 28 of cooling annulus 70 and the plurality of exit orifices 80 of the cooling annulus may be disposed at the upstream side 26 of the cooling annulus. Feed manifold 76 and the plurality of conduits in fluid communication with the plurality of exit orifices of the cooling annulus may be arranged over a circumferential sector (e.g., schematically represented by twin-headed arrow 82 in FIG. 9) of cooling annulus 70.

Further feed manifolds 84 may be arranged in fluid communication with respective further feed channels 86 to receive further cooling fluid. For example, the further feed manifolds 84 may be arranged to feed the further cooling fluid to respective further pluralities of conduits 88 in fluid communication with respective further pluralities of exit orifices 90 of the cooling annulus.

Figure 8:
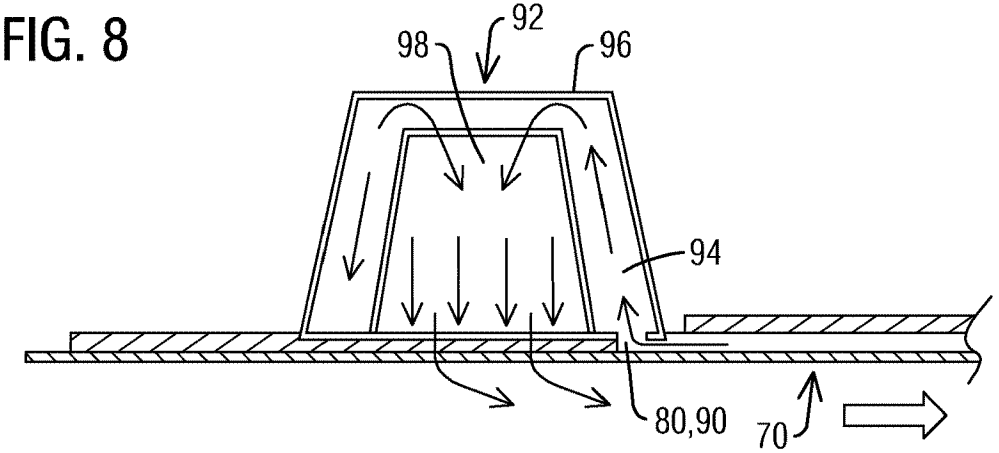
FIG. 8 shows a partial, cross-sectional view of another non-limiting embodiment of resonators that may benefit from a disclosed system.

A plurality of resonators 92 (for simplicity of illustration one such resonator, as may be welded or otherwise affixed to the liner is shown in FIG. 8) is in fluid communication with respective ones of the exit orifices 80, 90 of cooling annulus 70. As noted above, in practical embodiments, at least some of the plurality of resonators 92 may involve different resonator configurations that may require different amounts of cooling fluid. In one non-limiting embodiment, a respective group of the plurality of exit orifices 80, 90 of cooling annulus 70 may be respectively configured to supply an amount of the cooling fluid appropriate for a respective one of the plurality of resonators 92 in fluid communication with the respective group of the plurality of exit orifices of the cooling annulus. For example, the respective group of the plurality of exit orifices 80, 90 of the cooling annulus may comprise a different number of wall orifices and/or a different orifice geometry to supply the amount of the cooling fluid appropriate for the respective one of the plurality of resonators in fluid communication with the respective group of the plurality of exit orifices of the cooling annulus. For example, a group of exit orifices fluidly coupled to a resonator that needs a higher amount of the cooling fluid may include a higher number of orifices relative to a group of exit orifices fluidly coupled to a resonator that needs a lower amount of the cooling fluid.

In one non-limiting embodiment, as shown in FIG. 8, the respective group of the plurality of exit orifices 80, 90 of the cooling annulus may be in fluid communication with a chamber 94 defined by an enclosure 96 of the respective one of the plurality of resonators 92. Chamber 94 may in turn be in fluid communication with a cavity 98 of the respective one of the plurality of resonators. It will be appreciated that disclosed system embodiments effective for dual utilization of cooling fluid in the combustor section of a gas turbine engine are not limited to any particular type of resonators or resonator construction modality. Thus, disclosed system embodiments illustrated in the figures with specific resonator implementations should be construed in an example sense and not in a limiting sense.

In operation, disclosed embodiments are expected to provide in a cost-effective manner a robust and reliable system effective for dual utilization of cooling fluid in the combustor section of a gas turbine engine. Disclosed embodiments are expected to advantageously provide lower NOx emissions and increased engine efficiency, while also providing efficient cooling performance to the involved components.

While various embodiments of the present invention have been shown and described herein, it will be apparent that such embodiments are provided by way of example only. Numerous variations, changes and substitutions may be made without departing from the invention herein. Accordingly, it is intended that the invention be limited only by the scope of the appended claims.

What is claimed is:

1. A system effective for dual utilization of cooling fluid in a gas turbine engine, the system comprising:

a cooling annulus subject to a hot-temperature combustion flow received from a combustor basket and passing between an upstream side and a downstream side of the cooling annulus, the cooling annulus comprising a liner including at least one feed channel to receive the cooling fluid;

a feed manifold in fluid communication with the at least one feed channel to feed the cooling fluid to a plurality of conduits that extend in an upstream direction, the plurality of conduits in fluid communication with a plurality of exit orifices of the cooling annulus; and a plurality of resonators constructed in the liner in fluid communication with respective ones of the exit orifices of the cooling annulus, at least some of the plurality of resonators configured to operate with different amounts of the cooling fluid, wherein a respective group of the plurality of exit orifices of the cooling annulus is respectively configured to supply an amount of the cooling fluid for a respective one of the plurality of resonators in fluid communication with the respective group of the plurality of exit orifices of the cooling annulus, and an enclosure enclosing an exterior of the respective one of the plurality of resonators and defining a chamber therebetween, and wherein the respective group of the plurality of exit orifices of the cooling annulus is located within the chamber to pass the cooling fluid into the chamber after exiting the respective group of the plurality of exit orifices.

2. The system of claim 1, wherein the feed manifold is disposed proximate the downstream side of the cooling annulus.

3. The system of claim 2, wherein the plurality of exit orifices of the cooling annulus is disposed at the upstream side of the cooling annulus.

4. The system of claim 3, wherein the respective one of the plurality of manifold sectors of the distributor manifold comprise a different number of wall orifices and/or a different orifice geometry to supply the amount of the cooling fluid for the respective one of the plurality of resonators in fluid communication with the respective one of the plurality manifold sectors of the distributor manifold than another respective one of the plurality of manifold sectors of the distributor manifold configured to supply another amount of the cooling fluid for another respective one of the plurality of resonators.

5. The system of claim 2, wherein an entrance of the feed channel is disposed between the upstream side and the downstream side of the cooling annulus.

6. The system of claim 1, wherein the feed manifold and the plurality of conduits in fluid communication with the plurality of exit orifices of the cooling annulus are arranged over a circumferential sector of the cooling annulus.

7. The system of claim 1, wherein the plurality of conduits extend along coplanar axes in the cooling annulus.

8. The system of claim 1, wherein the respective group of the plurality of exit orifices of the cooling annulus comprises a different number of wall orifices and/or a different orifice geometry to supply the amount of the cooling fluid for the respective one of the plurality of resonators in fluid communication with the respective group of the plurality of exit orifices of the cooling annulus than another respective group of the plurality of exit orifices of the cooling annulus configured to supply another amount of the cooling fluid for another respective one of the plurality of resonators.

9. A system effective for dual utilization of cooling fluid in a gas turbine engine, the system comprising:

a cooling annulus subject to a hot-temperature combustion flow received from a combustor basket and passing between an upstream side and a downstream side of the cooling annulus, the cooling annulus comprising a liner including a plurality of conduits arranged to convey cooling fluid received at a plurality of admittance orifices to a plurality of exit orifices;

a distributor manifold comprising a plurality of manifold sectors in fluid communication with the plurality of exit orifices of the cooling annulus to receive the cooling fluid conveyed by the conduits;

a plurality of resonators in fluid communication with the distributor manifold, at least some of the plurality of resonators configured to operate with different amounts of the cooling fluid, wherein a respective one of the plurality of manifold sectors of the distributor manifold is configured to supply an amount of the cooling fluid for a respective one of the plurality of resonators in fluid communication with the respective one of the plurality of manifold sectors of the distributor manifold, an enclosure enclosing an exterior of the respective one of the plurality of resonators and defining a chamber therebetween, and wherein the respective group of the plurality of exit orifices of the cooling annulus is located within the chamber to pass the cooling fluid into the chamber after exiting the respective group of the plurality of exit orifices.

10. The system of claim 9, wherein the distributor manifold is disposed proximate the upstream side of the cooling annulus.

11. The system of claim 9, wherein the plurality of resonators comprises a common circumferentially extending wall including wall orifices in fluid communication with the distributor manifold to receive the cooling fluid.

12. The system of claim 9, wherein a respective one of the plurality of conduits comprises a first conduit segment extending in a downstream direction from a respective admittance orifice to a start of a second conduit segment routed from the downstream direction to an upstream direction, wherein the respective one of the plurality of conduits further comprises a third conduit segment extending in the upstream direction from an end of the second conduit segment to a respective exit orifice in fluid communication with the distributor manifold.

13. The system of claim 12, wherein a further one of the plurality of conduits comprises a conduit segment extending in the upstream direction from a respective admittance orifice spaced apart upstream from the respective admittance orifice of the first conduit segment to a respective exit orifice in fluid communication with the distributor manifold.

14. The system of claim 12, wherein the first conduit segment and the third conduit segment comprise straight conduit segments, and the second conduit segment comprises a curving conduit segment.

15. The system of claim 14, wherein the first conduit segment, the second conduit segment and the third conduit segment in combination define a J-shaped conduit.

16. The system of claim 12, wherein the first conduit segment, the second conduit segment and the third conduit segment extend along coplanar axes in the cooling annulus.

* * * * *